United States Patent [19]

Rambausek

[11] Patent Number: 5,040,459

[45] Date of Patent: Aug. 20, 1991

[54] DEVICE FOR METERING INK IN OFFSET PRINTING MACHINES

[75] Inventor: Hugo Rambausek, Wiesloch, Fed. Rep. of Germany

[73] Assignee: Heidelberger Druckmaschinen AG, Heidelberg, Fed. Rep. of Germany

[21] Appl. No.: 559,506

[22] Filed: Jul. 20, 1990

Related U.S. Application Data

[63] Continuation of Ser. No. 339,906, Apr. 12, 1989, abandoned, which is a continuation of Ser. No. 111,454, Oct. 21, 1987, abandoned, which is a continuation-in-part of Ser. No. 822,681, Jan. 23, 1986, abandoned, which is a continuation-in-part of Ser. No. 628,804, Jul. 9, 1984, abandoned.

[30] Foreign Application Priority Data

Jul. 9, 1983 [DE] Fed. Rep. of Germany ..... 3324893

[51] Int. Cl.[5] ..... B41F 31/04; B41F 31/06; B41F 33/16

[52] U.S. Cl. ..... 101/217; 101/365

[58] Field of Search ..... 101/363, 350, 365, 366, 101/207-210, 136, 148, 216-218

[56] References Cited

U.S. PATENT DOCUMENTS

| | | | |
|---|---|---|---|
| 3,958,509 | 5/1976 | Murray et al. | 101/365 |
| 4,211,167 | 7/1980 | Corse | 101/148 |
| 4,223,603 | 9/1980 | Faddis et al. | 101/138 |
| 4,452,139 | 6/1984 | Dahlgren | 101/148 |

FOREIGN PATENT DOCUMENTS

| | | |
|---|---|---|
| 3217569 | 11/1983 | Fed. Rep. of Germany . |
| 2000082 | 1/1979 | United Kingdom . |
| 2024457 | 1/1980 | United Kingdom . |

*Primary Examiner*—J. Reed Fisher

*Attorney, Agent, or Firm*—Herbert L. Lerner; Laurence A. Greenberg

[57] ABSTRACT

Device for metering a quantity of ink in an offset printing machine having a plate cylinder and ink applicator cylinder engaging the plate cylinder and having a diameter corresponding to that of the plate cylinder, including an ink cylinder having a cylindrical outer surface formed of rigid material, at least one metering member cooperatively engageable with the ink cylinder under a given pressure, the metering member having a metering surface extending axially parallel with and tangentially to the cylindrical outer surface of the ink cylinder, and stationary bearing means for supporting the metering member through the intermediary of an adjusting element responsive to pressure from a pressure-medium for varying an ink gap between the metering surface and the ink cylinder outer surface; and means for supplying pressure medium to the adjusting element including a device for varying the pressure of the pressure medium as a function of time in accordance with a respective ink consumption within a printing period.

5 Claims, 4 Drawing Sheets

Fig. 5
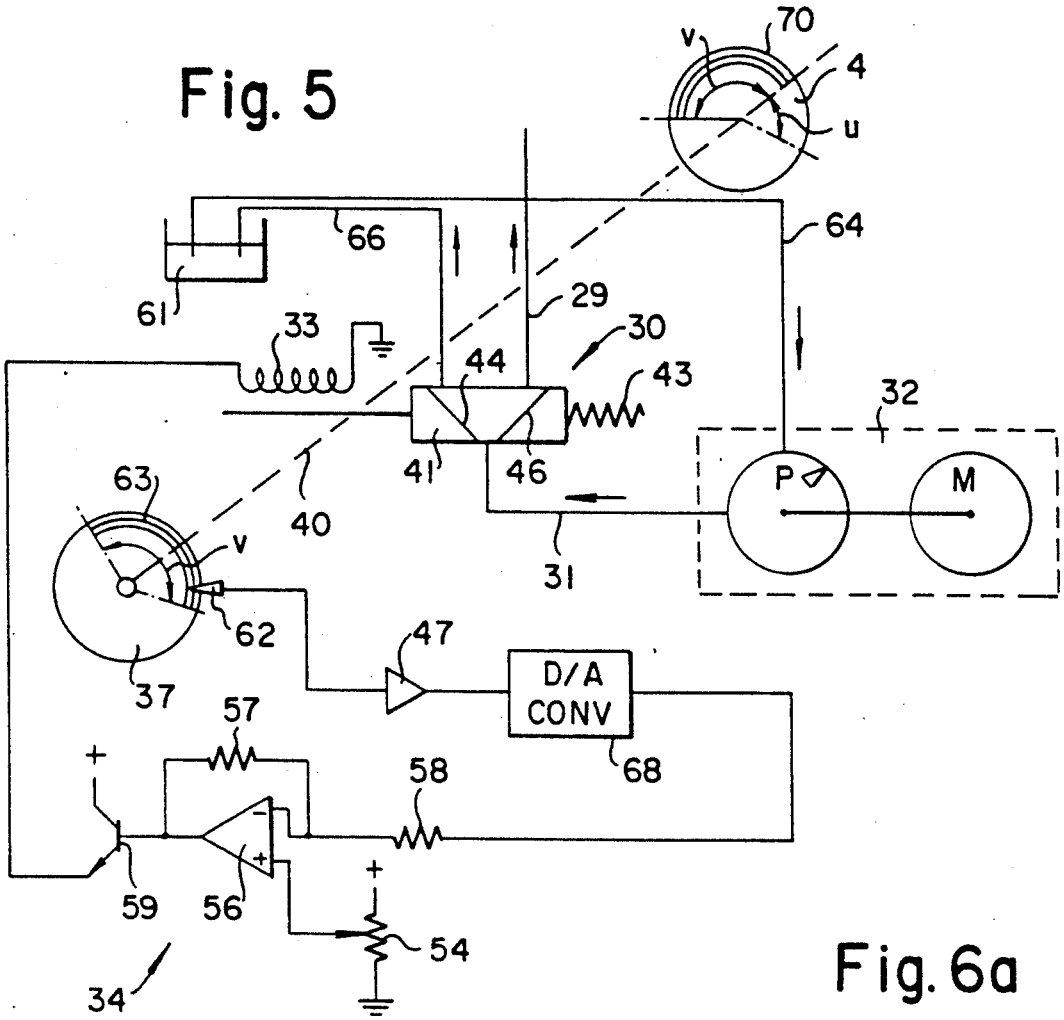
Fig. 6a
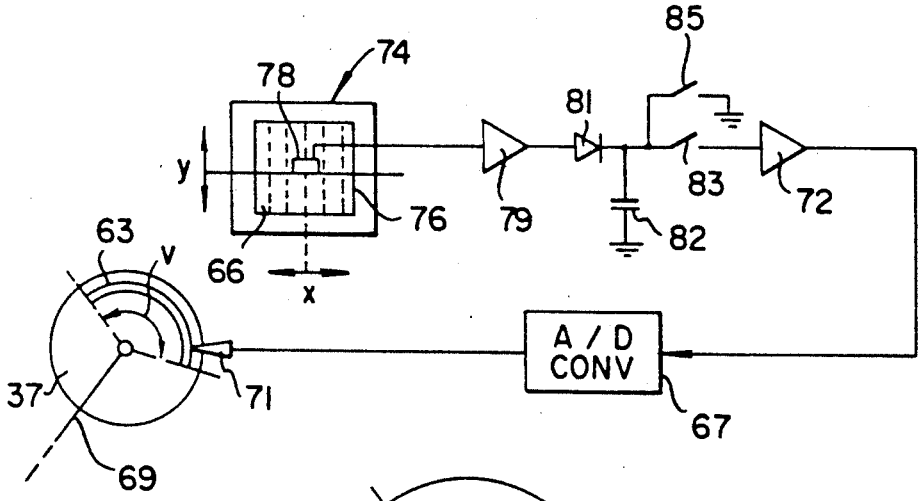
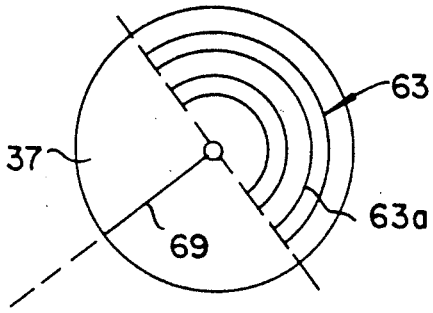
Fig. 6b

DEVICE FOR METERING INK IN OFFSET PRINTING MACHINES

CROSS-REFERENCE TO RELATED APPLICATIONS

This application is a continuation of application Ser. No. 339,906, filed Apr. 12, 1989, now abandoned, which is a continuation of Ser. No. 111,454 filed Oct. 21, 1987, now abandoned which is a Continuation-In-Part of application Ser. No. 822,681, filed Jan. 23, 1986, now abandoned which is a continuation of Ser. No. 628,804, filed July 8, 1984, now abandoned.

The invention relates to a device for metering ink in offset printing machines and is an improvement over the device described in co-pending application Ser. No 493,750, filed May 11, 1983 which is assigned to the same corporate assignee as that of the instant application.

In the co-pending application, an ink metering device is described which assures an absolutely uniform and reproducible ink feed in offset printing machines and, at little expense an exact regulation or control of the plate-cylinder inking. It is possible therewith to feed a uniformly thick ink film to the printing form or to obtain a zonewise varying ink feed over the width of the printing form. The fed ink quantity corresponds, in fact, to the varying consumption per inking zone during the entire printing period but not to the quantity required instantaneously on a time-varying basis depending upon the subject of the printing product.

In a zonewise control or regulation of the ink, ink stripes of varying thickness are fed to the plate cylinder and do not vary in circumferential direction of the plate. In practice, it more frequently occurs that the image which is to be printed requires quantities of ink not only varying in width zonewise, but also, as seen in circumferential direction of the plate cylinder, areas exist which require a greater or lesser quantity of ink. This is the case, for example, when the upper area of an image is printed with an intensely blue color. No ink, for example, is required instantaneously if the plate-cylinder clamping channel passes the ink applicating location. In an inking unit with many inking rollers and, consequently, a multiple-split ink flow, it is not possible to take into account such a varying ink consumption.

Starting from an inking unit with one or two form or applicator rollers having a diameter corresponding to that of the plate cylinder, in accordance with the aforementioned co-pending application, it is an object of the invention of the instant application to provide a device for metering ink wherein a varying ink profile is applied also in the circumferential direction of the plate cylinder in accordance with the quantity of ink required over the entire width or zonewise, so that the thickness of the ink film or layer is modulated in the circumferential direction i.e. so that the ink film or layer can be varied not only in width but also in circumferential direction in accordance with the need.

With the foregoing and other objects in view, there is provided, in accordance with the invention, a device for metering a quantity of ink in an offset printing machine having a plate cylinder and an ink applicator cylinder engaging the plate cylinder and having a diameter corresponding to that of the plate cylinder, comprising an ink cylinder having a cylindrical outer surface formed of rigid material, at least one metering member cooperatively engageable with the ink cylinder under a given pressure, the metering member having a metering surface extending axially parallel with and tangentially to the cylindrical outer surface of the ink cylinder, and stationary bearing means for supporting the metering member through the intermediary of an adjusting element responsive to pressure from a pressure-medium for varying an ink gap between the metering surface and the ink cylinder outer surface, and means for supplying pressure medium to the adjusting element including a device for varying the pressure of said pressure medium as a function of time in accordance with a respective ink consumption within a printing period.

The primary advantage of the invention in the instant application is that, with the given extremely short travel distances of ink to the plate cylinder through the use of one or two ink form rollers, it is possible also to perform a modulation of the thickness of the ink film of layer in circumferential direction of the plate cylinder so that, in accordance with the ink requirement of the printing image, delivers exactly the quantity of ink which is required, in the respective area. With the solution provided by the invention herein, it is thus possible to produce a given ink profile over the width or the circumference of the print form or to effect a relief-like regulation or control in both extensions or directions, so that also small partial areas on the print form can be supplied specifically with the required ink.

In accordance with another feature of the invention the pressure varying device includes a control for effecting a time-variation of the pressure-medium pressure with respect to instantaneous ink consumption, together with a lead-time corresponding to the required time for ink to travel from a metering location to the printing plate of the plate cylinder.

In accordance with a further feature of the invention, there is provided a plurality of the adjusting elements, and the control is for effecting a time-variation of the pressure-medium pressure zonewise for each of adjusting elements.

In accordance with an additional feature of the invention the pressure varying device comprises a cylinder having a piston displaceable therein, and including control means comprising a pressure-reducing valve connected to the cylinder for reducing pressure-medium pressure therein in response to a control signal which, for a given control sequence, is variable in time-span and in control size thereof.

In accordance with a concomitant feature of the invention, there is provided a disc whereon the control signal is recorded, the disc being driven in synchronism with the plate cylinder, and means for detecting the signal on the disc and transmitting the signal via an amplifier to a moving coil operatively connected with the respective pressure-reducing valve for controlling the valve.

Other features which are considered as characteristic for the invention are set forth in the appended claims Although the invention is illustrated and described herein as embodied in a device for metering ink in offset printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 5 is a schematic circuit diagram of the invention showing the controls for a hydraulic proportional valve controlling the circumferential ink feed.

FIG. 6*a* is a schematic circuit diagram of the apparatus for recording the circumferential ink film values.

FIG. 6*b* is a diagrammatic view of the recording disc 37, having multiple separate magnetic sub-tracks thereon.

Figure 1:
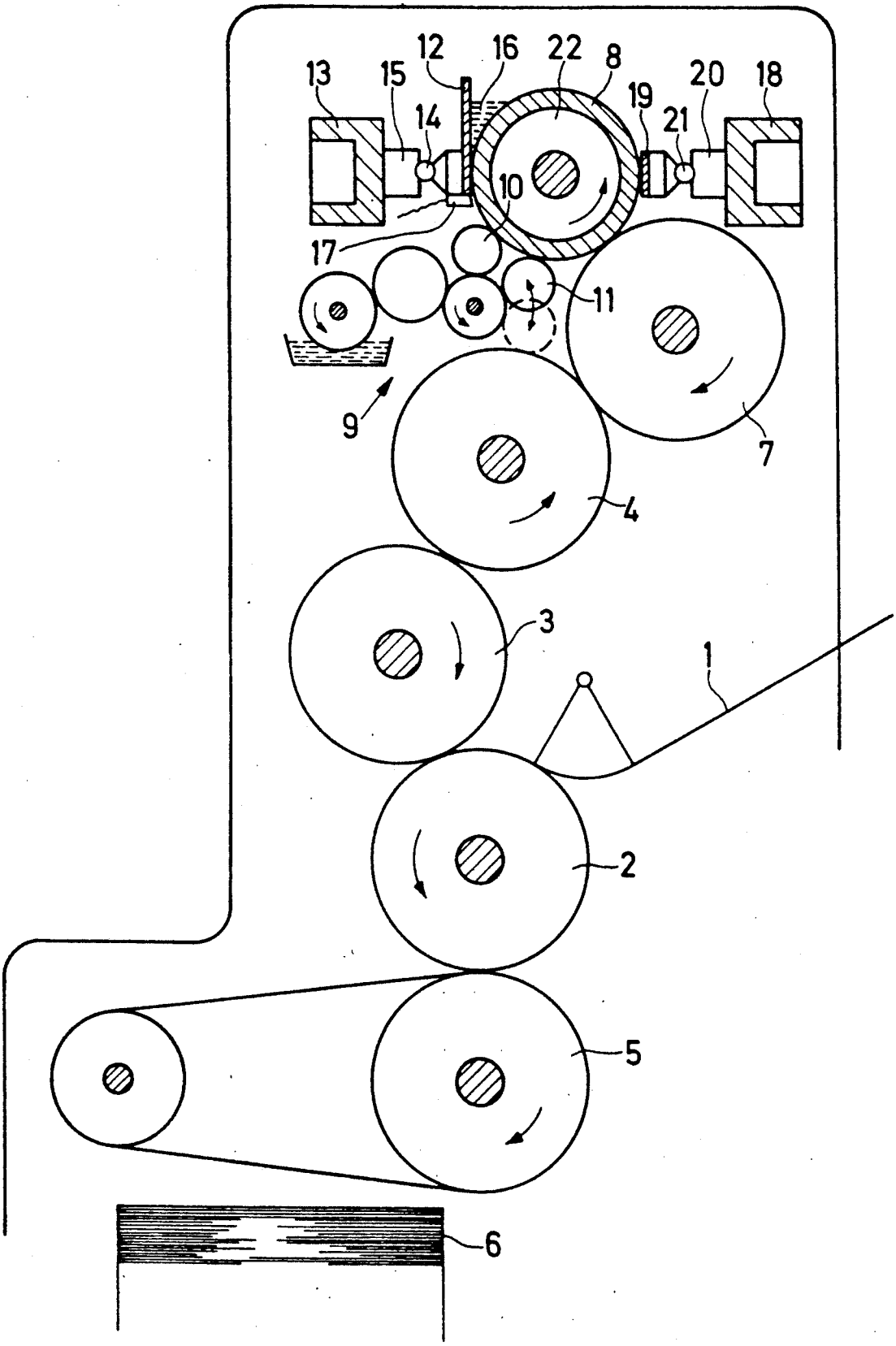
FIG. 1 is a diagrammatic side elevational view of an offset printing unit incorporating an ink metering device according to the invention.

Referring now to the drawing and first, particularly, to FIG. 1 thereof, there is shown diagrammatically an offset printing machine wherein, in a conventional manner, sheets to be printed are fed via a feeder 1 to an impression cylinder 2 cooperating with a blanket cylinder 3 and a plate cylinder 4. The print image is thus transmitted from the plate cylinder 4 via the blanket cylinder 3 onto the sheet to be printed which is on the impression cylinder 2. After printing, the sheet is transported by a chain delivery system 5 to a delivery pile 6. For printing a paper web instead of sheets, the paper web would be fed between the impression cylinder 2 and blanket cylinder 3 in a conventional manner.

An ink form roller 7 having an elastic outer cylindrical surface and a diameter corresponding to that of the plate cylinder 4 is associated with the latter cylinder, in the illustrated embodiment. The ink form roller 7 receives ink from an ink cylinder 8 having an outer cylindrical surface formed of rigid material, such as metal, for example A dampening unit 9 transfers dampening medium via two applicator rollers 10 and 11 to the ink cylinder 8, the last applicator roller 11, as viewed in rotary direction of the ink cylinder 8, being mounted so as to be pivotable against the plate cylinder 4, as shown in broken lines, to effect more rapid dampening.

A metering member 12 is associated with the ink cylinder 8 and is braced, via ball-and-socket joints 14 and via adjusting elements in the form of pressure-medium cylinders 15, only one thereof being shown in FIG. 1, on a crossbar or traverse 13 fastened to side frames of the machine. In the nip between the ink cylinder 8 and the metering member 12, an ink supply 16 is located. Sensors 17, which measure the thickness of the ink layer or film on the ink cylinder 8, are provided downstream of the metering member 12, as viewed in rotary direction of the ink cylinder 8.

Figure 2:
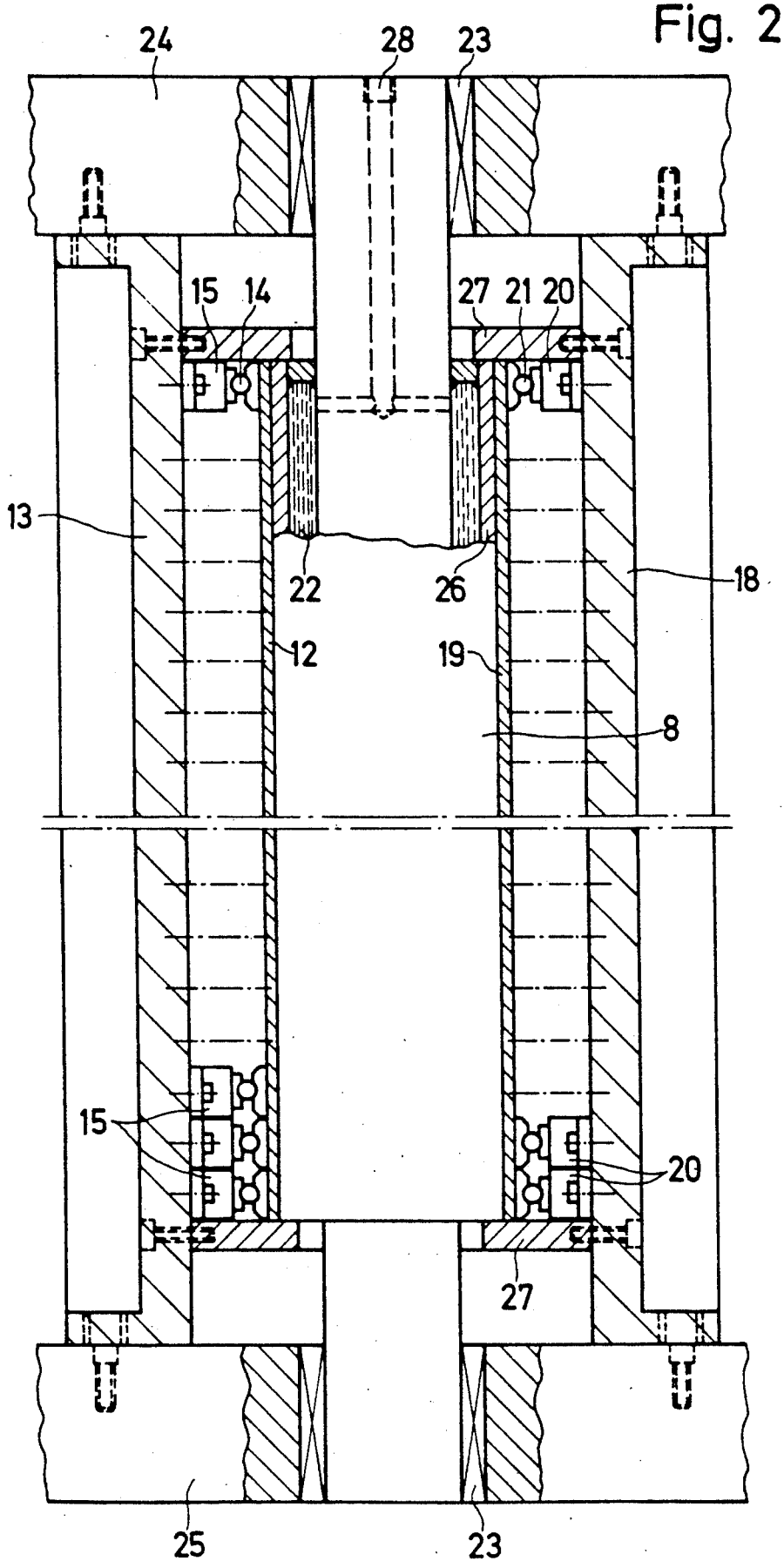
FIG. 2 is a longitudinal sectional view of FIG. 1 taken along a plane through the ink metering device.

On the side of the ink cylinder 8 located opposite the cross bar 13, there is another cross bar or traverse 18 against which a bracing or support member 19 is braced. Between the support member 19 and the cross bar 18, there are also provided pressure-medium cylinders 20 and ball-and-socket joints 21, only one thereof being shown in FIG. 1, which exert the same pressure as that exerted by the oppositely disposed pressure-medium cylinder 15, so that the forces acting upon the ink cylinder 8 are neutralized. Bending thereof is thereby avoided In the illustrated embodiment, the ink cylinder 8 has an inner chamber 22 which may be filled with a cooling liquid. FIG. 2 shows an ink metering device like that of FIG. 1 in a fragmentary longitudinal sectional view, with a bearing support for the ink cylinder 8 provided by roller bearings 23 mounted in side frames 24 and 25. The ink cylinder 8 has an outer cylindrical casing 26, the end faces of which are in close engagement with sealing jaws 27 for the ink. The sealing jaws 27, in turn, are fastened to the cross bars 13 and 18. The chamber 22 is connected, via a bore 28 formed in the shaft carrying the ink cylinder 8, to a non-illustrated cooling-medium circulatory loop.

Figure 3:
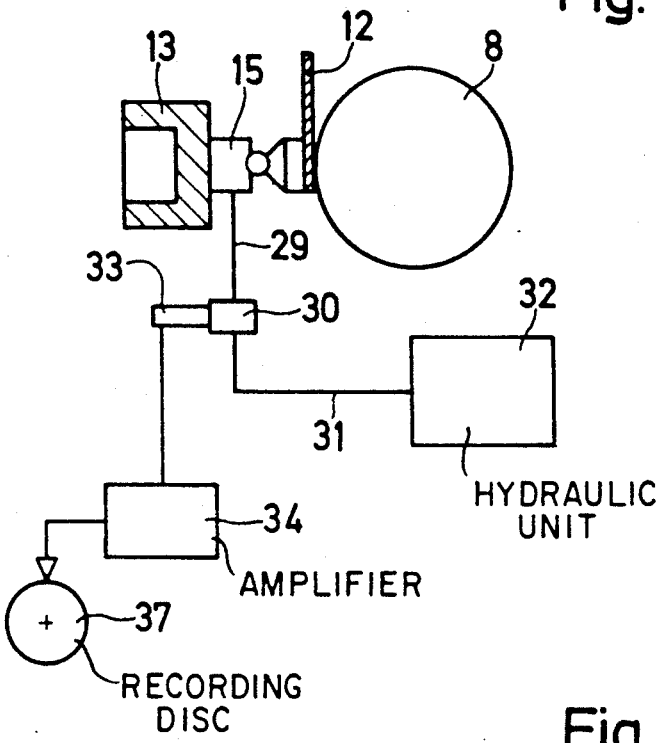
FIG. 3 is a fragmentary view partly schematic of FIG. 1 showing adjusting elements for the ink metering device.

The pressure-medium cylinders 15, as shown in FIG. 3, are connected via pressure-medium line 29 to a pressure-reducing valve 30 which is connected, in turn, by another line 31 to an hydraulic unit or system 32. The hydraulic unit 32 generates a pressure which is as high as is necessary to meet the maximum demands or loads applied to the metering member 12. The pressure is reduced via the pressure-reducing valve 30 to an extent necessary to meet the respective requirements. This reduction may be effected across the width of the machine uniformly or varying zonewise. A moving coil 33, for example, having an excitation controlled, via an amplifier 34 by a signal recorded on a disc 37 or an endless tape, serves for time-dependently varying the reduced pressure. The disc contains the information regarding the respectively required ink quantity for the subject to be printed. It rotates in synchronism with the plate cylinder 4, but with a lead, so that the time required for the travel of the ink from the metering location to the location at which it is applied is taken into consideration. The lead time depends upon the geometrical dimensions of the inking unit, and is equal and constant for all existing operations. The travel distance or stroke length of the pistons or membranes in the pressure-medium cylinders 15 are only a few microns (micro meters) so that the displaced volumes of pressure medium are very small. Consequently, variations in the thickness of the ink film or layer follows virtually immediately without any delay in response to the given signal.

The signal on the disc 37 can be set either as a result of a subjective assessment of the printing form or by being determined by a scanner. Regulation or control of the pressure-reducing valve 30 may be effected either analogically or digitally. Furthermore, other control elements may be used for varying the pressure instead of the moving coil 33. Thus, for example, varying the tension of the spring in the pressure-reducing valve by means of a control cam associated with the subject and rotating with the same speed as that of the machine is a possible simple mechanical solution.

Figure 4:
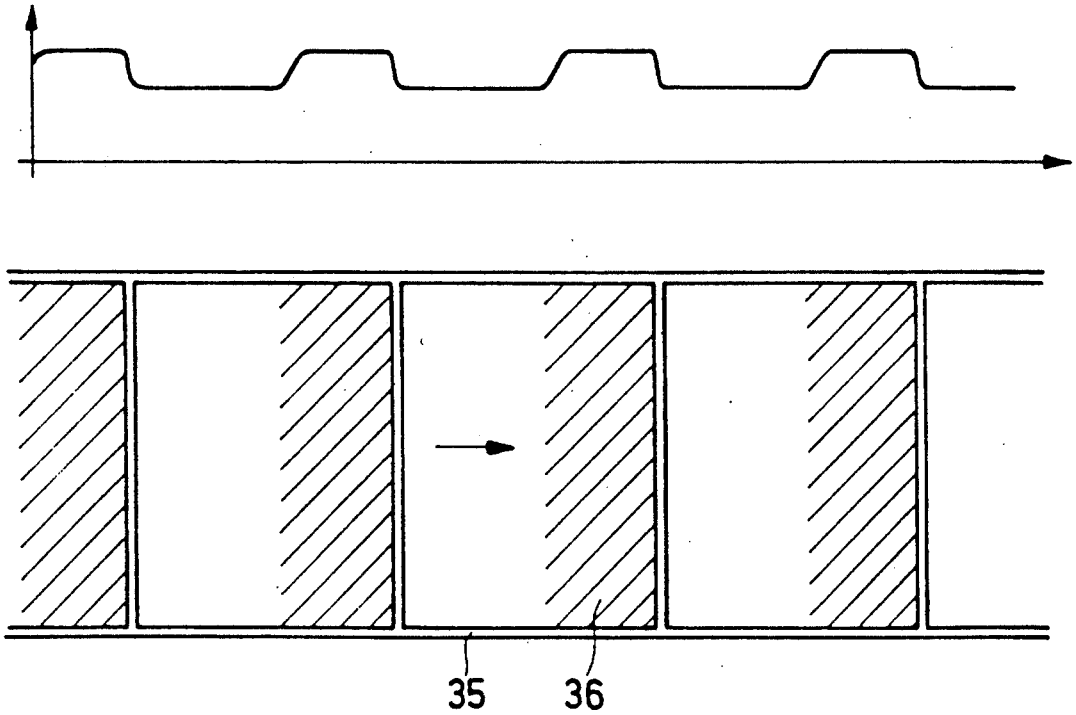
FIG. 4 is a plot diagram of a control scheme for a paper web which is to be printed.

At the bottom of FIG. 4, there is shown a paper web 35 with printed impressions 36 arranged thereon in relatively close succession. In the illustration of FIG. 4, the paper web 35 is moving towards the right hand side as indicated by the arrow. The impressions 36, respectively, at the right-hand side of each image, are represented by an area shown in single-line hatching which is supposed to indicate increased ink consumption. In accordance with the coordinate system shown at the top of FIG. 4, the impressions in the travel direction of the web are represented along the abscissa, and the respective required ink quantity along the ordinate. In the unhatched area of each impression shown at the bottom of FIG. 4, the ink feed is reduced and, in the hatched area, it is increased. Once the transport direction of the sheet or the web corresponds to the rotary direction of the plate cylinder 4, the supplied ink quantity is thus able to be regulated in the direction in accordance with the respective consumption. This may be effected zonewise so that an ink relief may be produced on the plate which corresponds to the requirement. A precondition of this ink metering is that the path of the ink to the plate cylinder 4 is very short in length and that the ink form roller 7 has a diameter corresponding to that of the plate cylinder 4, so that the ink relief is always produced on the same location of the surface area FIG. 5 is a schematic circuit diagram showing the major function blocks of the control elements -for the invention. In FIG. 5, the plate cylinder 4 is coupled synchronously via mechanical linkage 40, shown symbolically as a dashed line 40 with the recording disc 37, having a recording, e.g. magnetic, track 63 thereon. The track 63 may consist of, for example, 32 parallel magnetic sub-tracks 63*a*, each having a reading head 71, and corresponding to an ink zone. The recording track 63 has an angular extension of v degrees angle, which is equal to the angular extension v of the printing plate 70, attached to the plate cylinder 4. The hydraulic unit 32 is shown including a motor M driving a hydraulic pump P, drawing hydraulic fluid from a tank 61 via a pipe 64 and expelling the fluid under pressure via a pipe 31 connected to a conventional hydraulic proportional valve 30. The proportional valve 30 has the moving coil 33 in engagement with one end of the reciprocating movable valve spool 41; connected at the other end to a restoring spring 43. The valve spool 41 has internal fluid channels 4 and 46, respectively, connected via a fluid return pipe 66 leading to the fluid tank 61 and the fluid pressure pipe 29, leading to the pressure medium cylinder 15, seen in FIG. 1. The proportional valve 30 is constructed such that the incoming fluid flow from the pump P is divided between pipes 66 and 29 so that the fluid pressure in pipe 29 is proportional with the voltage applied to the moving coil 33. The moving coil 33 is connected to the amplifier 34, typically including an operational amplifier 56 driving a power amplifier including a power transistor 59, which in turn has its emitter connected to the coil 33. The operational amplifier 56 is connected with its inverting input to the analog output of a digital-to-analog converter 68, having its digital input connected to a reading head 62 serving to read digitally recorded ink film thickness values stored on the recording track 63, which represent the instantaneous ink film thickness to be applied to the part of the surface of the ink cylinder 8 for proper inking of the corresponding part of the printed image, to be transferred to the printed material.

The recording track may-hold the stored ink film values in either digital or analog form. In the exemplary embodiment, digital storage in conventional form, as known from digital recording, is contemplated. The digital ink film values, stored on the track 63, are read by a magnetic reading head 62, connected via an amplifier 47 to the input of a D/A converter 68, in turn controlling the ink film thickness being applied to the ink cylinder 8, and from there, the ink film being applied to the ink form roller 7 seen in FIG. 1 and the plate cylinder 4. It follows that the recording track 63 must be angularly offset from the printing plate 70 by a given angle u such that the instantaneous ink values being applied to the ink cylinder 8 will appear at the corresponding area of the image to be printed by the plate cylinder 4, as it contacts the printing medium. The angular offset is shown as the angle u in FIG. 5 on the plate cylinder 4.

The operational amplifier 56 is shown having a non-inverting input (+) connected to a potentiometer 54 for calibrating the amplifier. Resistors 57, 58 are conventional feed-back resistors.

FIG. 6*a* is a block diagram showing the method of recording the ink film values on the recording disc 37, which is shown detached from the linkage 40, but connected to the linkage 69 for angularly positioning the recording track 63 in relation to the recording head 71, during recording.

In preparation for recording the ink values, a copy 76 of the subject 76 to be printed is placed on the table of a scanner 74 under an ink density scanning head 78 of conventional construction, which is movable over the subject to be printed in x and y direction, as indicated. The subject to be printed is scanned in ink stripes 66, corresponding to the impression 36 in FIG. 4, indicated by dashed lines, each stripe having a width corresponding to the scanning width of the scanning head 78. The entire surface of the object to be printed is scanned in successive ink stripes 66.

The scanning head 78 produces an instantaneous electrical output proportional with the ink density of the area being covered by the scanning head 78, which is connected to an amplifier 79, in turn connected with its output to a circuit consisting of a rectifying diode 81 connected to a capacitor 82. For each complete scan of an ink stripe 66, e.g. from side to side of the print, the capacitor 82 is charged up to a potential which corresponds to the average ink density of the entire ink stripe. The average density is a measure of the amount of ink that has to be applied to the corresponding ink stripe of the printing plate in order to provide an ink consumption similar to that of the original subject 76. At the end of each scan of an ink stripe 66, the average ink density is momentarily transferred via the amplifier 72 to the input of an analog-to-digital converter 67 by momentarily closing the switch 83, after the recording disc 37 has been positioned to place an area of the recording track 63 corresponding to the ink stripe just scanned, and the ink density is recorded at that area of the track 63. After each recording of an ink stripe the capacitor is discharged by a switch 85 to zero potential, making it ready for the next scan. In that way, the average ink density for each ink stripe 66 is recorded in a corresponding location of the track 63.

After completed recording, the disc 37 may be placed in engagement with the plate cylinder 4 on the linkage or shaft 40 with the proper off-setting angle u. In the subsequent printing each sheet of material to be printed is fed from the feeder 1 to the press, such that the leading edge of the sheet meets the corresponding line of the printing plate, which has, at this time, been supplied with the proper amount of ink deposited thereon in the corresponding ink stripe, parallel with the axis of the cylinder, and as the sheet is being printed, one ink stripe after another, each ink stripe will meet the printed subject with the just right amount of ink deposited thereon, as described hereinabove.

There is claimed:

1. Device for metering a quantity of ink in an offset printing machine for printing successive prints each having a time varying ink consumption within a printing period for each of said prints, comprising a plate cylinder in the printing machine, a printing plate mounted on the plate cylinder, a single ink form cylinder engaging the plate cylinder and having a diameter equal to that of the plate cylinder, an ink cylinder having a cylindrical outer surface formed of rigid material, at least one metering member cooperatively engageable with said ink cylinder under a given pressure, said metering member having a metering surface extending axially parallel with and tangentially to the cylindrical outer surface of said ink cylinder, stationary bearing means for supporting said metering member, at least one adjusting element connected with stationary bearing means in operative engagement with said metering member, the adjusting element being responsive to pressure from a pressure-medium for varying an ink gap between the metering surface and the ink cylinder outer surface, means for supplying pressure medium to said adjusting element, and a device for varying the pressure of said pressure medium in timed coordination with the time varying ink consumption within said printing period for each of said prints connected with said adjusting element.

2. Metering device according to claim 1 wherein said device for varying the pressure of said pressure medium includes recording means for effecting time-variation of the pressure-medium pressure in accordance with the time varying ink consumption, and means for providing a lead-time corresponding to the required time for ink to travel from a metering location to the printing plate.

3. Metering device according to claim 1 including a plurality of adjusting elements, and an equal plurality of devices for varying the pressure of said pressure medium, wherein each of said devices for varying the pressure of said pressure-medium is connected with a respective one of said adjusting elements.

4. Metering device according to claim 2 including a pressure medium cylinder in said device for varying the pressure of said pressure medium, said pressure medium cylinder having a piston displaceable therein in engagement with said adjusting element, and a pressure-reducing valve connected to said pressure medium cylinder for reducing the pressure of said pressure medium, said pressure-reducing valve being responsive to a control signal from said recording means for varying said pressure in timed coordination with the time varying ink consumption of each of said prints.

5. Metering device according to claim 4 including a recording disc in said recording means whereon said control signal is recorded, means for driving said recording disc in synchronism with the plate cylinder, means for detecting said control signal and an amplifier for amplifying and transmitting said control signal to said pressure-reducing valve for controlling the valve.

* * * * *